United States Patent [19]

Abt

[11] Patent Number: 4,480,550

[45] Date of Patent: Nov. 6, 1984

[54] RELATIVE VELOCITY SENSOR FOR VOID SENSING FUZES AND THE LIKE

[75] Inventor: Edgar J. Abt, Tempe, Ariz.

[73] Assignee: Motorola, Inc., Schaumburg, Ill.

[21] Appl. No.: 402,010

[22] Filed: Jul. 26, 1982

[51] Int. Cl.[3] ..... F42C 11/06

[52] U.S. Cl. ..... 102/215; 102/216; 102/266

[58] Field of Search ..... 102/215, 216, 206, 262, 102/265, 266

[56] References Cited

U.S. PATENT DOCUMENTS

| | | | |
|---|---|---|---|
| 2,485,887 | 10/1949 | Jordan | 102/216 |
| 2,887,056 | 5/1959 | Perret | 102/216 |
| 3,158,705 | 11/1964 | Bliss | 102/216 |
| 3,589,295 | 6/1971 | Packer | 102/216 |
| 3,788,225 | 1/1974 | Held | 102/216 |
| 3,862,602 | 1/1975 | Manning | 102/266 |
| 3,955,508 | 5/1976 | Will et al. | 102/216 |
| 4,019,440 | 4/1977 | Strike | 102/215 |

FOREIGN PATENT DOCUMENTS

| | | | |
|---|---|---|---|
| 1588607 | 4/1981 | United Kingdom | 102/216 |

*Primary Examiner*—Charles T. Jordan

*Attorney, Agent, or Firm*—Jonathan P. Meyer

[57] ABSTRACT

A relative velocity sensor for projectile fuzes and the like provides adaptive penetration delay for maximum effectiveness. A pair of contact activated switches on the fuze spaced a known distance apart provide electrical signals useful for calculating the relative velocity of the projectile with respect to a target. An adaptive penetration delay circuit utilizes these signals to detonate the projectile after a delay period determined by the relative velocity. Low graze angle impacts will cause immediate detonation of the fuze. The invention provides simple, effective means for achieving adaptive target penetration delay with very low in-flight power consumption.

9 Claims, 4 Drawing Figures

POWER SOURCE
50
VOLTAGE REGULATOR
54
52
REFERENCE
56
POWER-ON-RESET
58
$V_{DD}$
POR
POR
POR
CLOCK
UP-DOWN COUNTER
68
DUAL FREQUENCY GATED CMOS RC OSCILLATOR
64
66
70
72
74
FIRE COMMAND
DETONATOR
76
78
80
82
84
86
88
90
92
94
96
60
62
$V_{DD}$
TARGET SENSOR
DEMODULATION
PENETRATION LATCH

RELATIVE VELOCITY SENSOR FOR VOID SENSING FUZES AND THE LIKE

FIELD OF THE INVENTION

The present invention relates, in general, to projectile fuzes for detonating a charge within a void space of a target. More particularly, the invention relates to a sequenced electrical contact sensor for determining a delay time between target contact and detonation.

BACKGROUND OF THE INVENTION

Maximum destructive effect of anti-aircraft projectiles and the like occurs if the projectile detonates within the target. Because the velocity of the detonation products has a component determined by the velocity of the projectile prior to detonation, the precise delay time between target impact (or skin penetration) and detonation should ideally be a function of the projectile velocity. More accurately, since the proper frame of reference for determining maximum destructive effect is that of the target, the delay time should be determined by the relative velocity between the target and the projectile. Furthermore, since impacts at extremely low angles of incidence will result in shallow target penetration or no penetration, the projectile should respond to this situation by detonating immediately.

It is possible to realize or approximate the above described function in a number of ways. Most accurately, perhaps, a Doppler radar or similar system can continuously measure target distance and relative velocity to adjust the delay time. This would be a highly sophisticated system and would consume large amounts of power, thus being difficult to implement in small caliber projectiles. It is also possible to approximate relative velocity by some measure of projectile velocity. For instance, a time of flight measurement could be made or a velocity versus spin rate comparison could be used. Both methods would require power continuously throughout the flight of the projectile and would be insensitive to target velocity and angle of incidence.

SUMMARY OF THE INVENTION

Accordingly, it is an object of the present invention to provide an improved relative velocity sensor for use with projectile fuzes and the like.

It is a further object of the present invention to provide an improved relative velocity sensor which is sensitive to the angle of incidence.

Yet another object of the present invention is to provide an improved relative velocity sensor which does not consume power continuously throughout projectile flight.

A particular embodiment of the present invention includes a pair of electrical switches spaced apart by a predetermined distance along the nose of the fuze. The switches are sequentially activated by contact with the skin of a target providing electrical signals from which the relative velocity of the projectile with respect to the target, and hence the proper penetration delay, may be calculated. An up-down counter is enabled to count up at a first clock rate during the interval between the activation of the first and second switches, providing a measure of relative velocity. The counter is enabled to count down at a second clock rate when a void sensing means indicates entry of the projectile into a target void. In an alternate embodiment of the present invention the down count commences with the activation of the second switch. This alternate embodiment ignores the effect of target skin thickness, but avoids the requirement of void sensing means. When the down count passes the initial state of the counter, projectile detonation is triggered. The relationship between the first and second clock rates is chosen to provide the desired target penetration distance. At very low angles of incidence a reverse sequence switch activation provides the signal for immediate projectile detonation. Since the relative velocity sensor of the present invention is in a standby mode until target contact, almost no power is required throughout the flight. The decreased power supply requirements of the present invention are a significant advantage in small caliber projectiles.

These and other objects and advantages of the present invention will be apparent to one skilled in the art from the detailed description below taken together with the drawings.

DETAILED DESCRIPTION OF THE INVENTION

Figure 1:
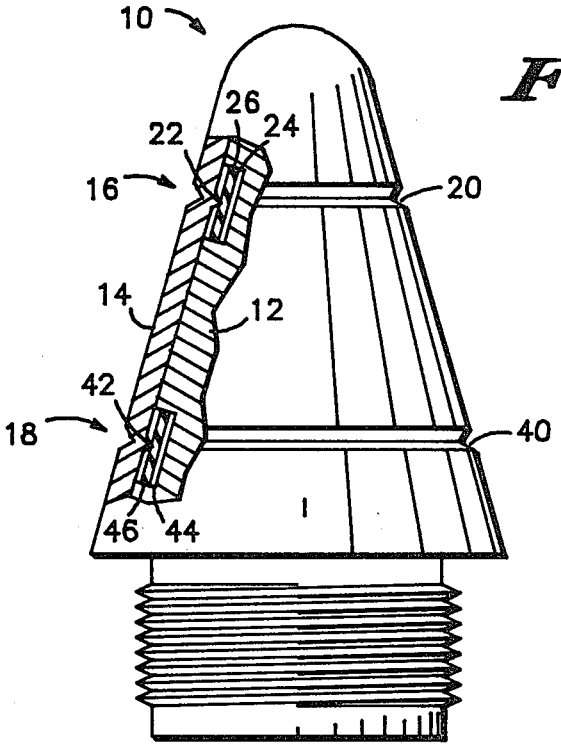
FIG. 1 is a partially cut away view of a projectile fuze having contact activated switches according to the present invention.
Figure 3:
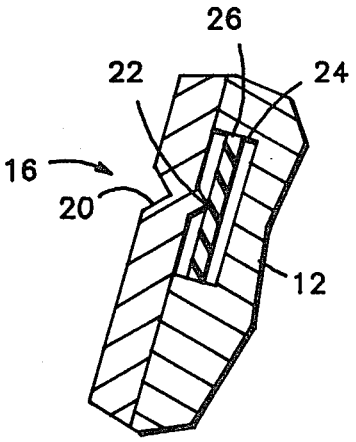
FIG. 3 is an enlarged cross-sectional view of a contact activated switch according to the present invention.
Figure 2:
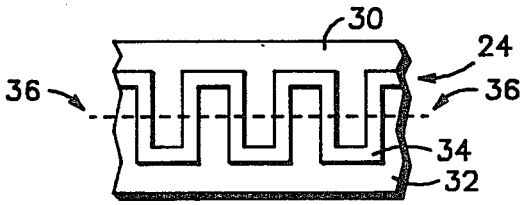
FIG. 2 is an enlarged view of a portion of a contact activated switch according to the present invention.

Referring to FIGS. 1, 2 and 3 a projectile fuze 10 having first and second contact activated switches 16 and 18 is shown. A body 12 is covered by a metal cowl 14. A first annular depression 20 in cowl 14 forms a first annular coined edge 22 on the inner surface of cowl 14. A flexible circuit 24 bonded to body 12 is separated from coined edge 22 by electrical insulation 26. Flexible conductor 24 comprises a first conductive layer 30 and a second conductive layer 32 disposed on a flexible insulating backing 34. In the normal, or open position of switch 16, conductive layers 30 and 32 are electrically insulated from one another. However, when annular depression 20 makes contact with or passes through the skin of a target, cowl 14 is deformed so as to force coined edge 22 through insulation 26 to make contact with conducting layers 30 and 32 along contact line 36. This closes switch 16 by providing a conduction path between conducting layer 30 and conducting layer 32. Second contact activated switch 18 comprising second annular depression 40, coined edge 42, flexible circuit 44 and insulation 46 is similarly activated when annular depression 40 makes contact with the target skin. Since first and second contact activated switches 16 and 18 are spaced apart along fuze 10 by a known distance, the time between the activation of switch 16 and the activation of switch 18 is a measure of the relative velocity of fuze 10 with respect to the target. In addition, it is apparent that a reverse sequence activation of switches 16 and 18 corresponds to a very low angle of incidence of impact between fuze 10 and the target, thus indicating that the immediate detonation is required.

Figure 4:
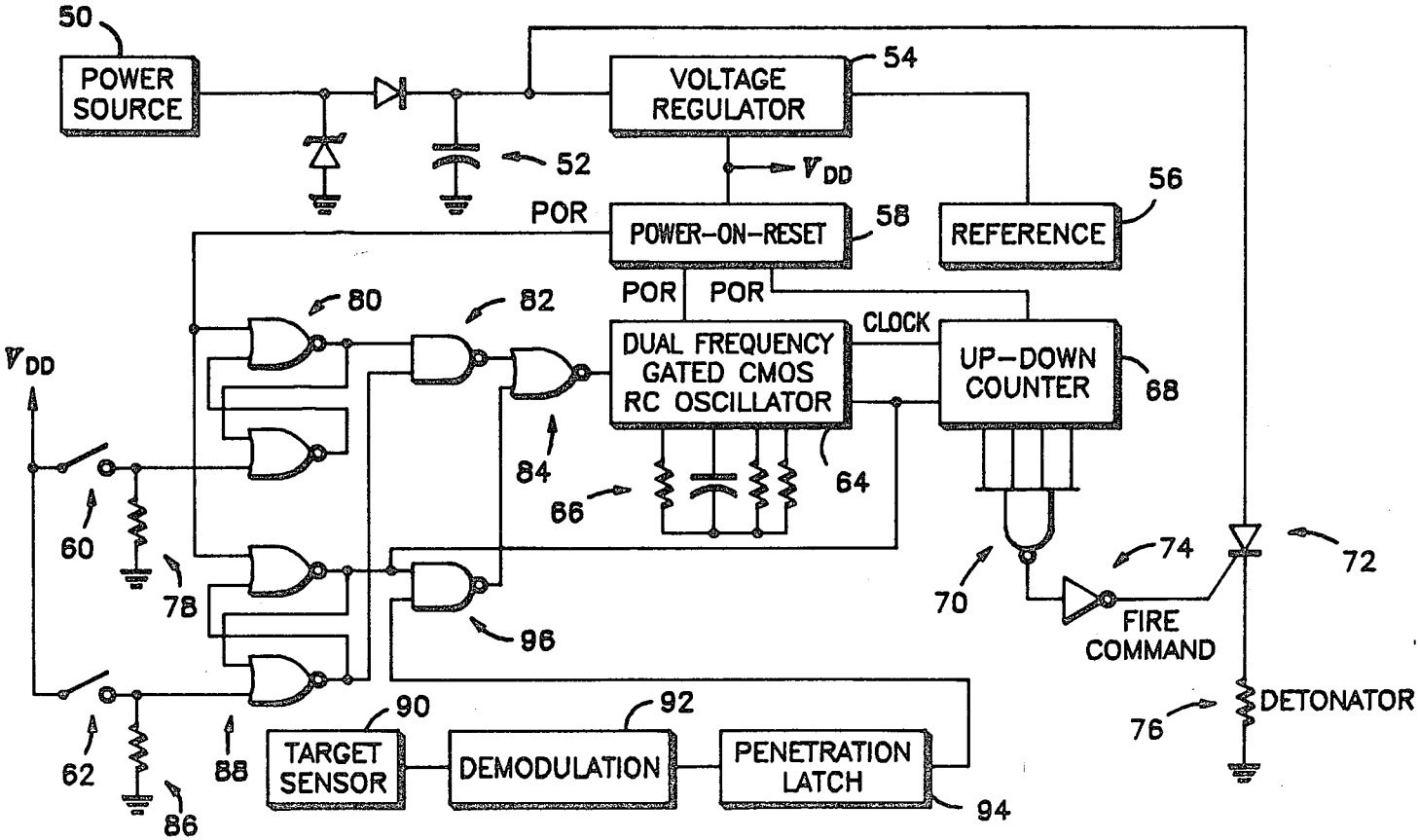
FIG. 4 is a schematic diagram of an adaptive target penetration delay circuit according to the present invention.

Referring now to FIG. 4 a schematic diagram of an adaptive target penetration delay circuit according to the present invention is shown. A setback operated power source 50 is activated by the firing of the projectile and supplies power to a firing capacitor 52 and voltage regulator 54 which, by means of reference 56, supplies voltage regulated power to the remainder of the circuit. A power-on-reset device 58 responds to the initiation of power by supplying a reset signal to the various gates and other logic devices of the circuit. Once the circuit is initialized it is in a standby mode in which very little power is consumed.

In the initialized state first and second contact activated switches 60 and 62 are open, a dual frequency gated CMOS oscillator 64 is disabled and RC network 66, which controls the frequency of oscillator 64, is set to a first clock frequency and up-down counter 68 is set to all 0's and an up mode. This makes the output of NAND gate 70 negative which reverse biases diode 72 through inverter 74. Thus, detonator 76 is prevented from firing.

Upon activation of first contact activated switch 60 a voltage drop appears across resistor 78. The resulting signal propagates through flip-flop circuit 80, NAND gate 82, and NOR gate 84 to enable oscillator 64. Oscillator 64, in turn, provides a first clock frequency to up-down counter 68 which begins to count up. Upon activation of second contact activated switch 62 a voltage drop appears across resistor 86. This signal propagates through flip-flop circuit 88, NAND gate 82 and NOR gate 84 and disables oscillator 64. This preserves in up-down counter 68 a measure of the time required for the projectile to traverse the distance between first switch 60 and second switch 62. In addition, the signal from the closure of second switch 62 changes disabled oscillator 64 to a second clock frequency and changes up-down counter 68 to a down mode. The next event which occurs is the passage of the projectile into a void space of the target. This is sensed by a target sensor 90, which may be for instance a piezoelectric crystal, a demodulator 92 and a penetration latch 94. Several different types of deceleration sensitive mechanisms will be apparent to one skilled in the art to fulfill the void sensing function. A void entry signal from penetration latch 94 propagates through NAND gate 96 and NOR gate 84 to re-enable oscillator 64 which provides the second clock frequency to up-down counter 68. Up-down counter 68 counts down at the second clock frequency until the initialized state is passed; that is, until the counter rolls over to an all 1's state. At this point, the output of NAND gate 70 becomes negative which causes inverter 74 to supply a fire command to diode 72. Diode 72 is forward biased and firing capacitor 52 explodes detonator 76.

The amount of target penetration is chosen by means of the relationship between the first and second clock frequencies. For instance, if the distance between contact activated switches 60 and 62 is one centimeter and 30 centimeters of target penetration is desired then the second clock frequency should be 30 times lower than the first clock frequency.

In an alternate embodiment of the present invention the requirement of void sensing means is avoided. This is accomplished by ignoring the time required for the projectile to fully penetrate the target skin and enter a target void. In other words, the down counting mode at the second clock frequency is commenced upon activation of contact activated switch 62 rather than on the occurrence of a void entry signal. Since the thickness of the anticipated target skin will generally be small as compared to the desired penetration distance this will generally not significantly interfere with the operation of the fuze. In addition, the deletion of void sensing means may be a significant advantage in small caliber fuzes. The alteration of the circuit depicted in FIG. 4 to accomplish this change will be apparent to one skilled in the art.

While the invention has been particularly shown and described with reference to a preferred embodiment thereof, it will be understood by those skilled in the art that various other modifications and changes may be made to the present invention from the principles of the invention described above without departing from the spirit and scope thereof.

I claim:

1. A relative velocity sensor for a projectile fuze comprising:

a first electrical switch at a first location on a projectile, said first switch being responsive to contact of said first location with a target skin by producing a first electrical signal;

a second electrical switch at a second location on said projectile, said second switch being responsive to contact of said second location with a target skin by producing a second electrical signal; and timing means responsive to said first and second electrical signals for producing an adaptive delay time and for detonating said projectile when said adaptive delay time is up.

2. A relative velocity sensor according to claim 1 wherein:

said timing means is responsive to said first electrical signal for starting a first count at a first counting rate, and is responsive to said second electrical signal for stopping said first count and for starting a second count at a second counting rate, and is responsive to a condition wherein said second count is greater than said first count for detonating said projectile.

3. A relative velocity sensor according to claim 1 further comprising:

void sensing means for producing a void-entry electrical signal upon passage of said projectile through said target skin, said timing means being responsive to said void-entry signal for starting said adaptive delay time to run.

4. A relative velocity sensor according to claim 1 wherein said timing means comprises:

an up-down counter, initially in an up mode;

a dual frequency oscillator;

first logic means responsive to said first electrical signal for enabling said dual frequency oscillator to provide a first clock frequency to said up-down counter;

second logic means responsive to said second electrical signal for disabling said oscillator, for changing said oscillator to a second clock frequency, and for changing said counter to a down mode;

void sensing means for producing a void-entry signal upon passage of said projectile through said target skin;

third logic means responsive to said void-entry signal for enabling said dual frequency oscillator to provide said second clock frequency to said counter; and means responsive to the roll-over of said counter to an all 1's state for detonating said projectile.

5. A relative velocity sensor according to claim 1 wherein said timing means comprises:

an up-down counter, initially in an up mode;

a dual frequency oscillator;

first logic means responsive to said first electrical signal for enabling said dual frequency oscillator to provide a first clock frequency to said up-down counter;

second logic means responsive to said second electrical signal for changing said up-down counter to a down mode and changing said oscillator to a second clock frequency; and means responsive to the roll-over of said counter to an all 1's state for detonating said projectile.

6. A relative velocity sensor according to claim 1 or claim 2 or claim 3 or claim 4 or claim 5 wherein said timing means is responsive to a reverse sequence activation of said first and second switches to detonate said projectile immediately.

7. In a projectile having first and second contact activated switches disposed a predetermined distance apart thereon a method of providing adaptive target penetration delay comprising the steps of:

counting up from zero at a first rate from the activation of said first switch until the activation of said second switch;

counting down at a second rate from the activation of said second switch; and detonating said projectile when a count of zero is passed.

8. In a projectile having first and second contact activated switches disposed a predetermined distance apart thereon, a method of providing adaptive target penetration delay comprising the steps of:

counting up from zero at a first rate from the activation of said first switch until the activation of said second switch;

sensing penetration of said projectile into a void space;

counting down at a second rate from said penetration; and detonating said projectile when a count of zero is passed.

9. A method of providing adaptive target penetration delay according to claim 7 or claim 8 further comprising the step of:

detonating said projectile in response to a reverse sequence activation of said first and second switches.

* * * * *